US005996147A

United States Patent [19]

Trimble

[11] Patent Number: 5,996,147

[45] Date of Patent: Dec. 7, 1999

[54] BEDSHEET AND PILLOWCASE COMBINATION

[76] Inventor: Lynn Trimble, 17772 Bridle La., Jupiter, Fla. 33478

[21] Appl. No.: 09/112,636

[22] Filed: Jul. 9, 1998

[51] Int. Cl.[6] ..... A47G 9/00

[52] U.S. Cl. ..... 5/482; 5/485; 5/490; 5/500

[58] Field of Search ..... 5/485, 490, 496, 5/497, 502, 500, 482, 419

[56] References Cited

U.S. PATENT DOCUMENTS

| | | | |
|---|---|---|---|
| 2,586,031 | 2/1952 | Hahne . | |
| 3,148,388 | 9/1964 | Espersen . | |
| 3,638,251 | 2/1972 | Weiss . | |
| 3,739,408 | 6/1973 | Pagels | 5/496 |
| 3,906,559 | 9/1975 | Bahr | 5/496 |
| 5,099,530 | 3/1992 | Scott | 5/500 X |
| 5,189,744 | 3/1993 | Roberts | 5/497 |
| 5,438,719 | 8/1995 | Anthony . | |
| 5,497,521 | 3/1996 | Waits et al. | 5/482 X |
| 5,557,814 | 9/1996 | Cybulski | 5/485 X |
| 5,644,807 | 7/1997 | Battistella | 5/419 |
| 5,729,846 | 3/1998 | Sullivan | 5/923 X |
| 5,887,300 | 3/1999 | Pond | 5/490 X |

FOREIGN PATENT DOCUMENTS

| | | | |
|---|---|---|---|
| 7440932 | 7/1976 | France | 5/497 |

*Primary Examiner*—Terry Lee Melius
*Assistant Examiner*—Rodrigo Morales
*Attorney, Agent, or Firm*—McHale & Slavin PA

[57] ABSTRACT

A sheet construction adapted to secure a pillow and to fittingly engage a mattress includes a main panel having a first pouch at a first end of the panel and a second pouch at a second end of the panel. The first pouch is sized and shaped to encompass a first end of the mattress, while the second pouch is adapted to encompass a second end of the mattress. The second pouch includes cooperating flaps that extend from the main panel and overlap. An auxiliary panel cooperates with the main panel to form a pillow-receiving concealment pocket. The pouches secure the sheet construction to the mattress, and the concealment pocket maintains a pillow in a desired location during use. In an alternative embodiment, the pouches are sized and oriented to encompass the mattress sides.

16 Claims, 5 Drawing Sheets

BEDSHEET AND PILLOWCASE COMBINATION

FIELD OF THE INVENTION

This invention is directed to bedding, and more particularly, to a bedsheet that fittingly engages a mattress and safely maintains the pillow in a concealed location.

BACKGROUND OF THE INVENTION

Conventional bed linens typically include a set of mattress-covering sheets and at least one pillowcase. The sheet set may include a fitted sheet and a flat sheet; the pillowcase is usually a separate pouch having an open end through which a pillow is inserted. With this arrangement, the mattress and associated pillows are protected by coverings that may be removed for laundering and replaced as needed. As a result, the common sheet-and-pillowcase system promotes cleanliness within the sleeping environment, without the need for mattress and pillow replacement. However, while this approach leads to improved hygiene, it is not suitable for all situations. Cribs and beds used by young sleepers are an area of particular concern. Hotels, hospitals, nursing homes, and other institutions also present unique requirements.

Many institutions provide sleeping quarters for large numbers of guests. On a daily basis, stripping down and replacing the associated bed linen can require large amounts of time. This activity often occupies staff members that might otherwise be interacting directly with guests. To reduce the time needed for bed linen swapping, some bed sheets simplify the linen changing process by providing integrated pillowcase-and-sheet combinations.

U.S. Pat. No. 2,586,031, for example, teaches a bed sheet having an attached pillow-receiving sleeve. Although this bedsheet simplifies the bed making process, it is not suitable for environments where pillow theft is common, such as hospitals and hotels. The pillow sleeve has open ends, and an inserted pillow may be removed or dislodged easily. This design is also dangerous for use with small children: an infant's limbs may become tangled within the sleeve and painfully twisted if the child rolls about.

To eliminate limb injuries and to curb pillow removal temptations, some sheets include sleeves that completely enclose a pillow. U.S. Pat. No. 3,148,388, for example, teaches a sheet having an attached pillowcase that includes flaps to selectively conceal an associated pillow. Although this arrangement encloses a pillow, the pillowcase is still exposed to the sleeper, and pillow removal is a matter of merely untying a few securing straps. These straps may also present choking hazards to young children.

Other sheet sets dispense with discrete pillowcases entirely. U.S. Pat. No. 3,638,251, for example, teaches a sheet that lies flat against a mattress, but includes a tapered section under which a pillow may be placed. While this design eliminates the need for a distinct pillow case, it is not suitable for all sleepers. With this design, a sleeper's motion may cause a pillow to shift position during use. Because the pillow is remote from the sleeper, repositioning the resultant "wandering" pillow is difficult. An incorrectly placed pillow is uncomfortable, at best, and can be dangerous, to certain individuals. Small children, for example, may become wedged by the pillow against crib wall bars.

Still other designs include pillowcases that are permanently attached to a sheet. U.S. Pat. No. 5,438,719 discloses a pillowcase attached to a sheet along a zippered seam. A pillow is inserted into the pillowcase through the seam, and the seam is zipped shut. Because the pillowcase is hingedly fastened to the sheet, this design is unsafe for very small children. An infant may wriggle under the pillowcase and have trouble breathing.

Although the known sheet-and-pillowcase bed linen combinations do represent advancements in some areas, none are suitable for use with infants. In attempting to create theft-resistant or time-saving combinations, designers have incorporated elements that may be dangerous to sleepers who are very young.

What is needed is a bedding sheet construction that incorporates the benefits of prior art and eliminates shortcomings thereof. The device should be useful for all types of beds, but should maintain a pillow at a preselected location in a manner safe for children. The sheet construction should keep the pillow and compartment away from a child if desired. Additionally, the sheet construction should be hard to remove when the bed is occupied, but easy to install and remove when the bed is unoccupied.

SUMMARY OF THE INVENTION

The present invention is a sheet construction that engages a mattress securely and provides a concealed compartment for a pillow. The sheet construction includes a main panel having mattress-encompassing pouches at opposite ends. One of the pouches is formed by two cooperating flaps that overlap and are detachably secured together. An auxiliary panel attached to the main panel creates a pillow-receiving concealment pocket. With this arrangement, the pouches cooperatively secure the sheet construction to the mattress, and the concealment pocket will maintain a pillow in a preset location. The auxiliary panel may be located on top of the main panel, or may face towards a mattress. Orienting the auxiliary panel towards the mattress creates a child-safe concealment pocket that is not accessible when the mattress is occupied.

The flapped pouch aspect of the present invention makes the sheet easy to install. This feature also makes the sheet construction advantageously difficult to remove when the bed is occupied, yet promotes easy removal when the bed is empty. This prevents unwanted sheet and pillow removal and keeps bed occupants from becoming tangled in the sheet, while reducing suffocation dangers inherent with a loose pillow. The present invention is useful on both large and small beds, for children and for adults.

Thus, an object of the present invention is to provide a sheet construction that maintains a pillow at a preselected location in a manner safe for children.

An additional object of the present invention is to provide a sheet construction that is difficult to remove while a bed is occupied, but easy to install and remove when the bed is empty.

A further object of the present invention is to provide a sheet construction that essentially locks a pillow in a preselected position.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
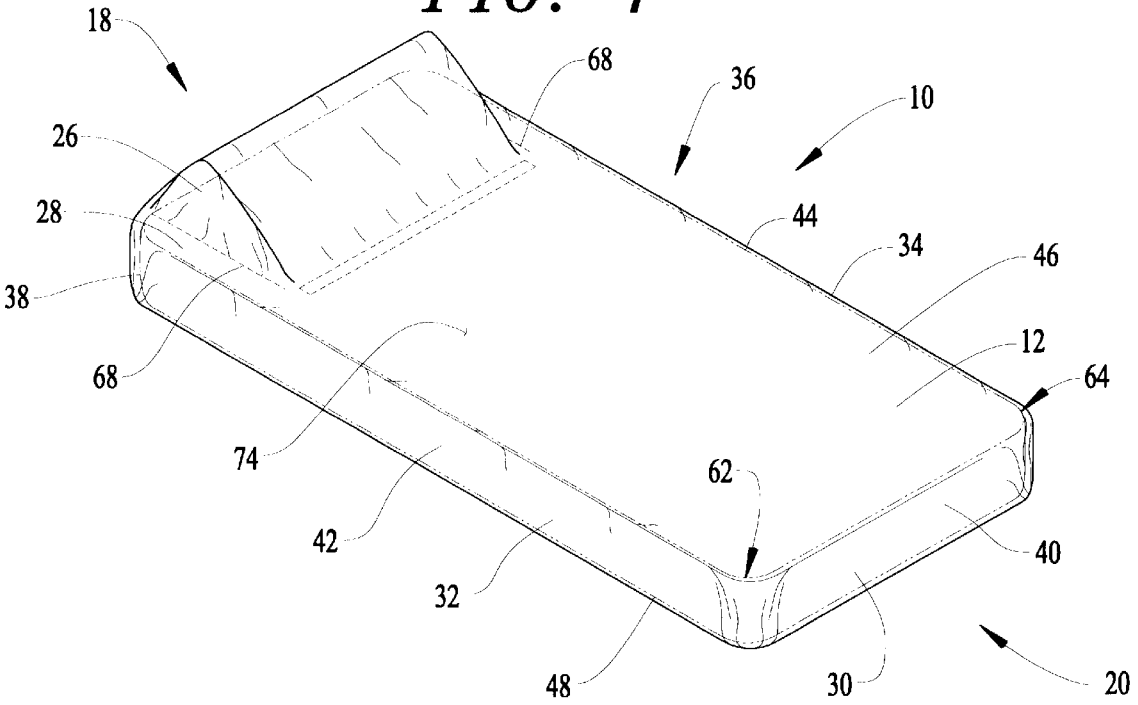
FIG. 1 is a pictorial view of the sheet construction of the present invention, shown in use on a mattress.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 2:
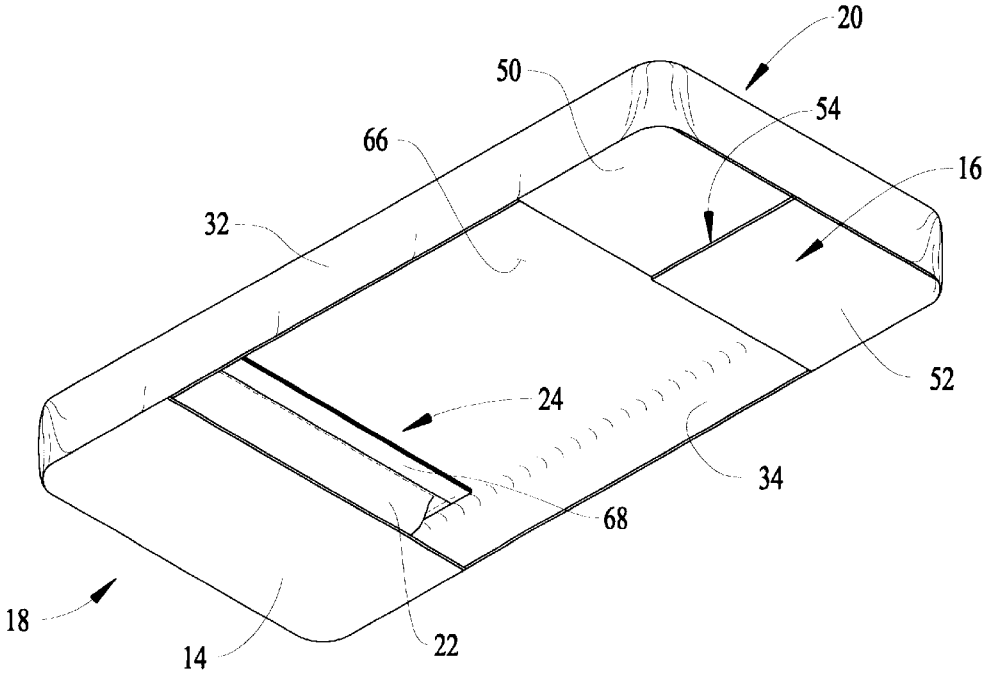
FIG. 2 is a bottom perspective view of the sheet construction shown in FIG. 1.

Now with reference to FIGS. 1 and 2, the sheet construction 10 of the present invention is shown. By way of overview, the sheet construction 10 includes a main panel 12 having pouches 14,16 located at opposite ends 18,20 thereof. The sheet construction 10 also includes an auxiliary panel 22 that cooperates with the main panel 12 to form a pillow-receiving concealment pocket 24. The pouches 14,16 help secure the main panel to the mattress and the concealment pocket 24 confines a pillow 26 inserted therein. The details of the sheet construction 10 will now be discussed.

With additional reference to FIG. 2, the main panel 12 is a substantially-rectangular piece of fabric having a first end 28 spaced apart from a second end 30. The main panel 12 is sized to fit a desired style of mattress, e.g. queen, king, twin, or baby crib. Each of the panel ends is characterized by a scoop-like pouch 14,16. Each pouch 14,16 acts as a receptacle into which a portion of a mattress 36 is fed. The pouches 14,16 may be formed integral with the main panel 12 or may be discrete items fastened to the main panel. Additionally, the pouches 14,16 may be elasticized, if desired, to accommodate mattresses 36 of various size.

With continued reference to FIG. 1, the mattress 36 includes a first end 38, a second end 40, a first side 42, and a second side 44. The mattress 36 is further characterized by a top face 46 and an opposite bottom face 48. During use, the sheet construction main panel 12 lies against the mattress top face 46.

Figure 3A:
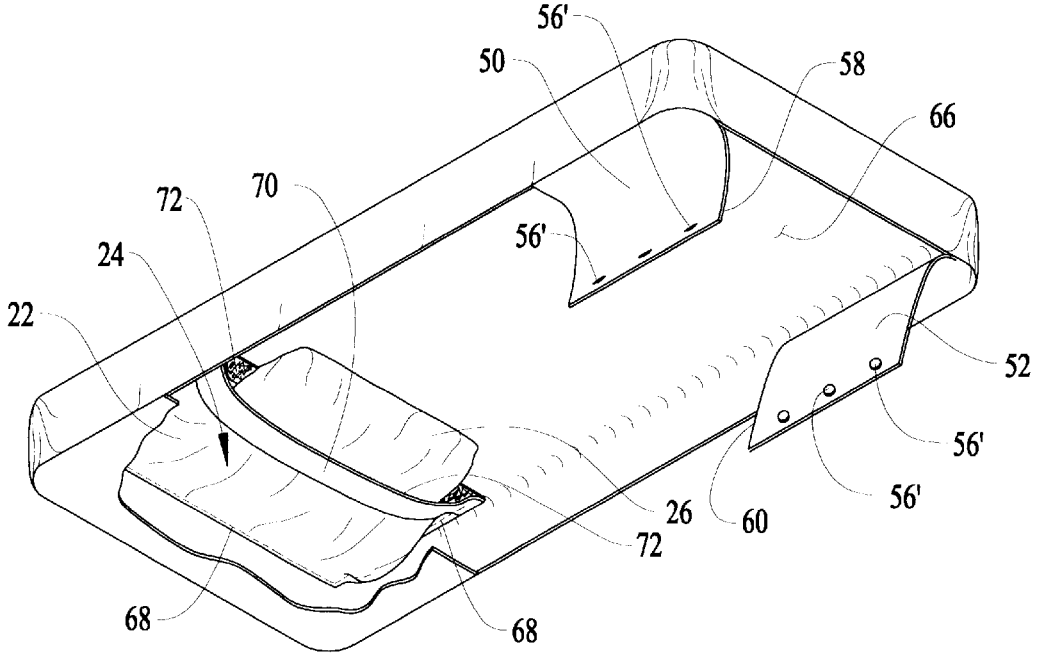
FIG. 3A is a bottom perspective view of the sheet construction shown in FIG. 1, having the second pouch flaps adapted with buttons for securement.
Figure 3:
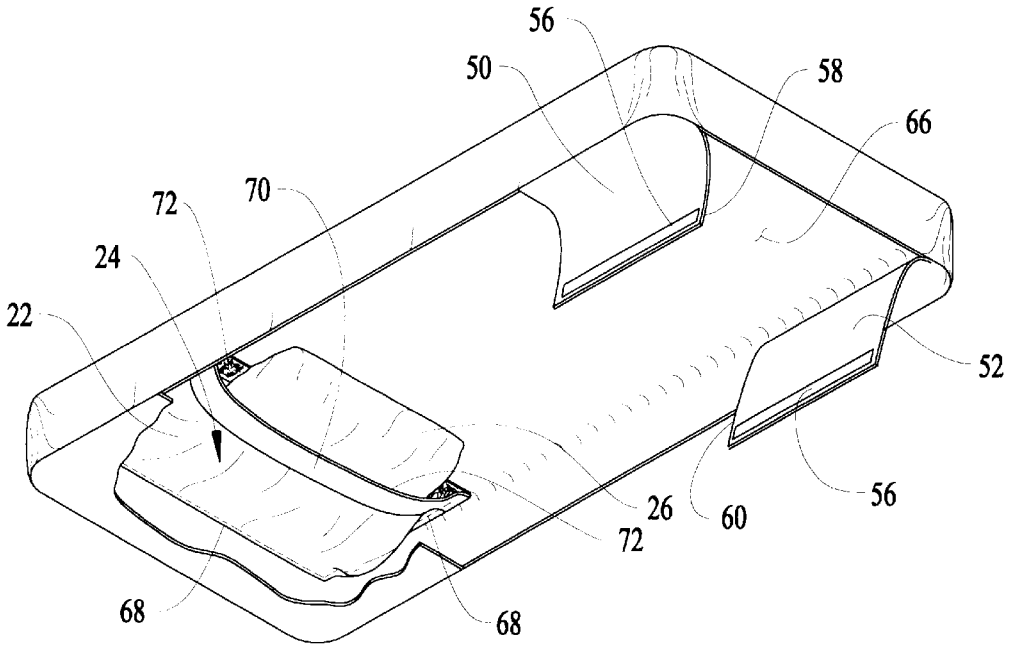
FIG. 3 is a bottom perspective view of the sheet construction shown in FIG. 1, having the second pouch flaps separated and the concealment pocket open.
Figure 3B:
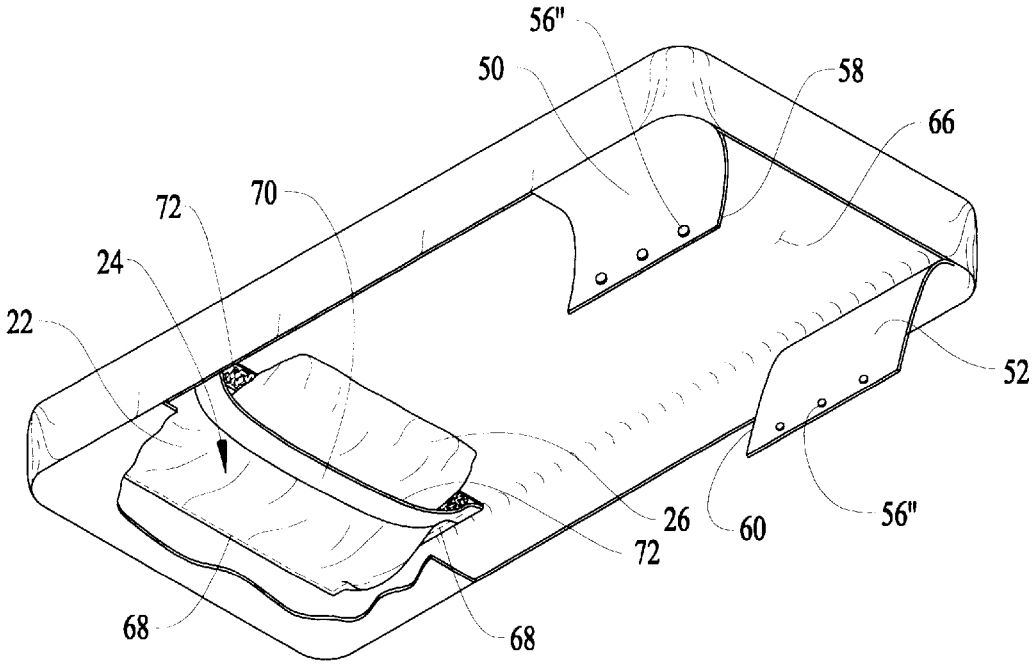
FIG. 3B is a bottom perspective view of the sheet construction shown in FIG. 1, having the second pouch flaps adapted with snaps for securement.
Figure 3C:
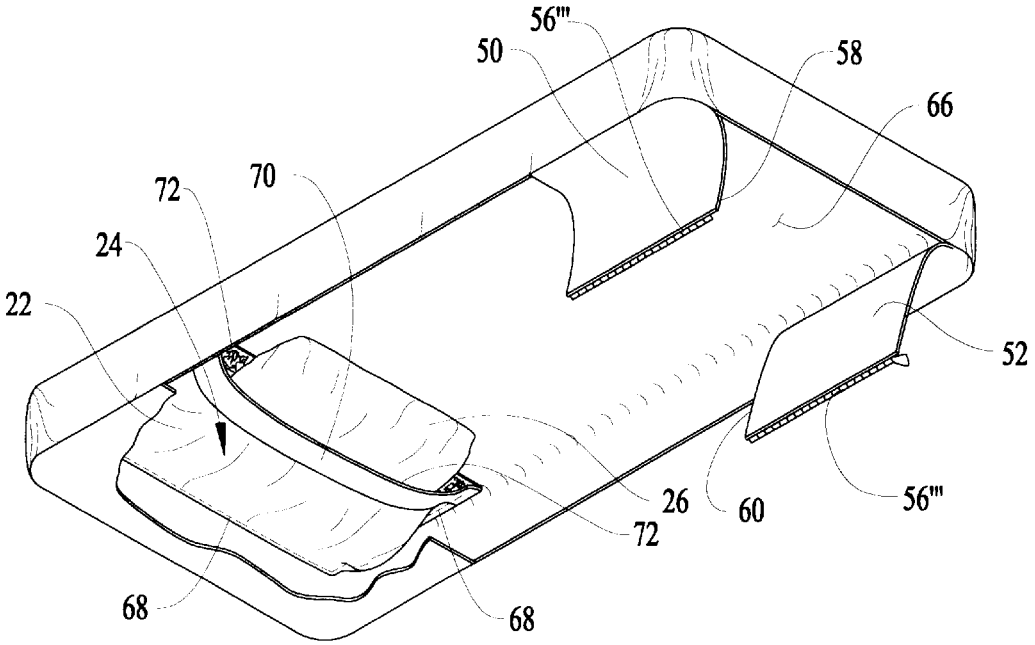
FIG. 3C is a bottom perspective view of the sheet construction shown in FIG. 1, having the second pouch flaps adapted with a zipper for securement.

In a preferred embodiment, the first and second pouches 14,16 are sized and positioned to encompass the mattress first and second ends 38,40, respectively. In keeping with the objects of this invention, the second pouch 16 is formed from a pair of cooperating flaps 50,52 that extend from the main panel 12. As shown in FIG. 2, the flaps 50,52 overlap along a central securing seam 54. As shown in FIG. 3, releasable fastening material 56 is disposed along the overlapping portions 58,60 of the flaps 50,52. The fastening material 56 is preferably hook-and-loop type material, such as that available under the trademark VELCRO. Although hook-and-loop type material is preferred, other fasteners, such as buttons 56', snaps 56", or zippers 56'", may also secure the flaps, as shown in FIGS. 3A, 3B, and 3C. Alternatively, the flaps 50,52 may be sized so as not to overlap. The sheet construction 10 may also be made with pouches 14,16 that are identical. That is, both pouches 14,16 may include a plurality of flaps 50,52 or both may be made without cooperating flaps.

During use, the first pouch 14 is slid onto the first end 38 of the mattress 36, the main panel 12 is spread along the top face 46 of the mattress 36, and the flaps 50,52 are wrapped around the corners 62,64 of the mattress second end 40. Once the sheet construction 10 is in place, the second pouch 16 flaps 50,52 are overlapped and pressed together along the securing seam 54; the fastening material 56 keeps the flaps in place. With this arrangement, the pouches 14,16 cooperate to encompass the mattress ends 38,40, securing the sheet construction 10 onto the mattress 36. These steps are reversed to remove the sheet construction 10.

Figure 4:
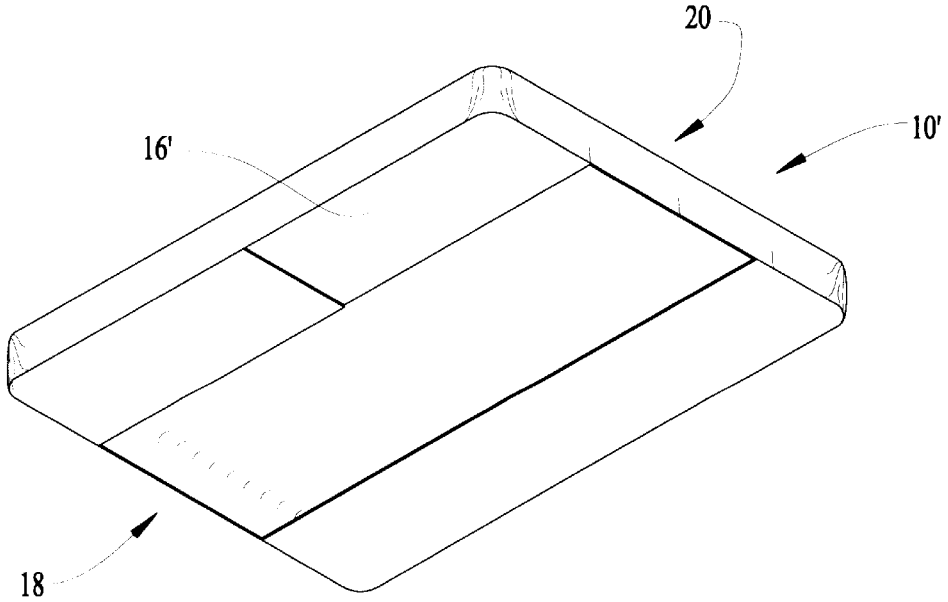
FIG. 4 is a pictorial view of an alternate embodiment of the sheet construction of the present invention, shown with pouches that engage the sides of a mattress.

Although the sheet construction has been described as having pouches 14,16 that encompass the mattress ends 38,40, other orientations are also possible. In a second embodiment, shown in FIG. 4, the position of the pouches 14',16' is rotated ninety degrees. In the this embodiment 10', the pouches 14',16' are enlarged to fit the mattress first and second sides 42,44, respectively. The sheet construction second embodiment 10' is applied and removed in a manner similar to the first embodiment, except that the pouches 14',16' engage the mattress sides 42,44. This arrangement makes the sheet construction 10' easier to use on some mattresses.

As seen in FIGS. 2 and 3, the sheet construction 10 also includes an auxiliary panel 22 attached to the main panel lower surface 66. The main panel lower surface 66 faces the mattress top face 46 when the sheet construction is in use. In a preferred embodiment, the auxiliary panel 22 is rectangular and located near the first end 28 of the main panel 12. The perimeter of the auxiliary panel 22 is characterized by three attachment edges 68 that are permanently attached to the main panel 12. With this arrangement, the main panel 12 and the auxiliary panel 22 form a concealment pocket 24 that holds the pillow 26 in place. With particular reference to FIG. 3, the fourth edge 70 of the auxiliary panel 22 is an insertion edge past which the pillow 26 may be inserted into the concealment pocket 24.

The auxiliary panel 22, may be sized to accommodate pillows 26 of various shapes. For example, as shown in FIG. 1, the pillow may be wedge-shaped to provide an inclined resting surface. Alternatively, as shown in FIG. 3, the pillow may be a conventional, flat pillow.

Figure 2A:
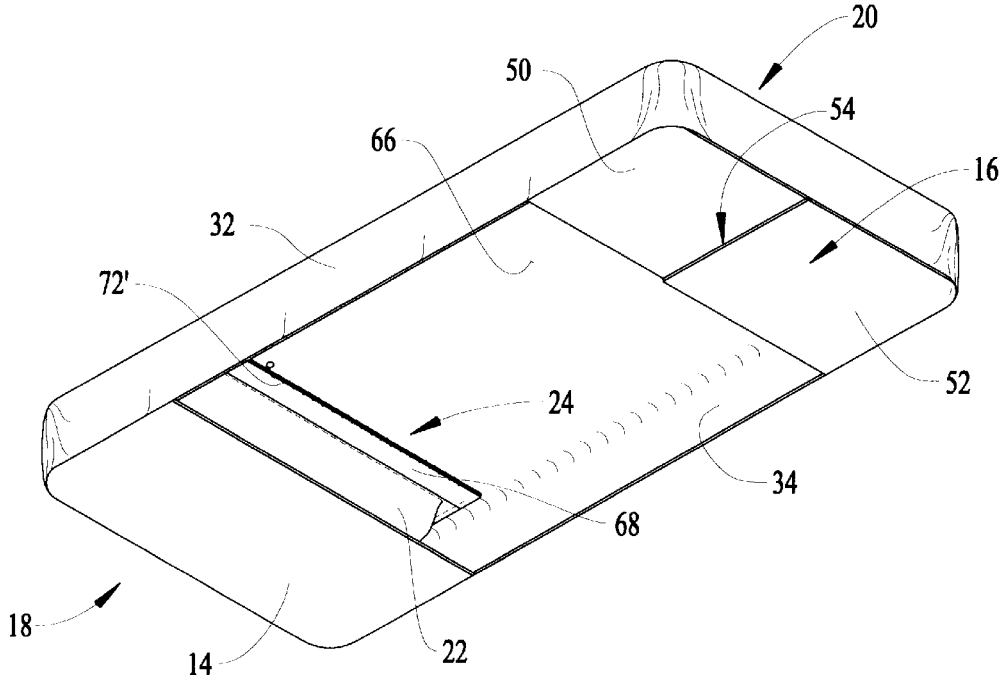
FIG. 2A is a bottom perspective view of the sheet construction shown in FIG. 1, with the auxiliary panel secured with a zipper.
Figure 2B:
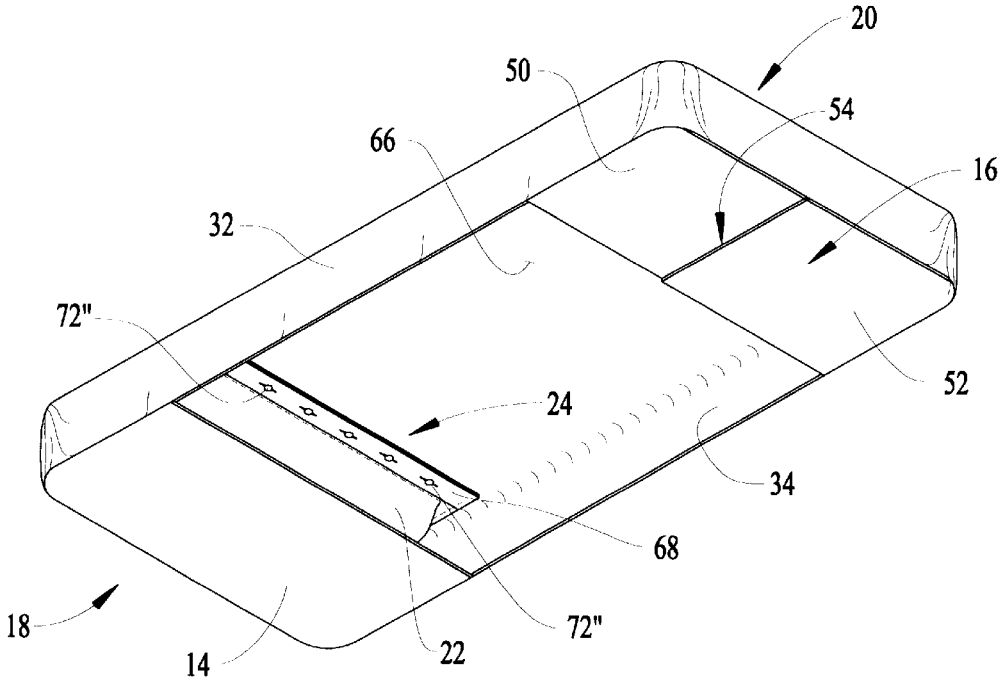
FIG. 2B is a bottom perspective view of the sheet construction shown in FIG. 1, with the auxiliary panel secured with buttons.
Figure 2C:
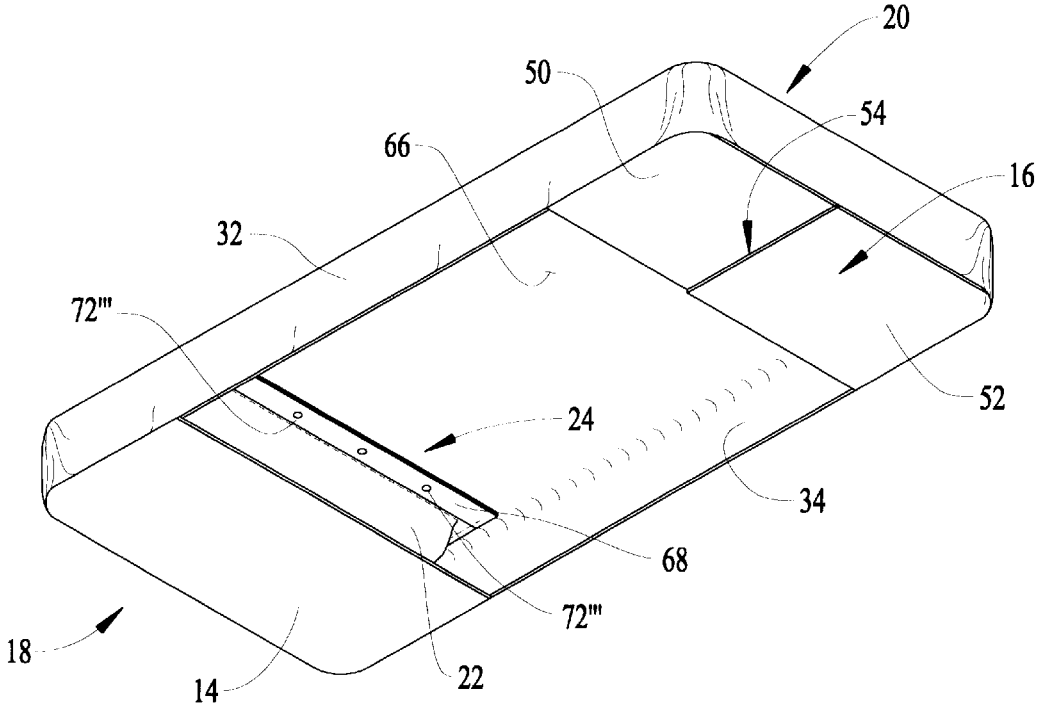
FIG. 2C is a bottom perspective view of the sheet construction shown in FIG. 1, with the auxiliary panel secured with snaps.

Securing material 72 placed along the insertion edge 70 and a corresponding portion of a main panel lower surface 66, may be used to selectively close the concealment pocket 24. The securing material 72 is preferably hook-and-loop type material, such as that sold under the trademark VELCRO. Although the securing material is not required, its presence helps ensure that a pillow 26 placed within the concealment pocket 24 will not move during use. Furthermore, the attachment edges 68 and the insertion edge 70 may all be fashioned to include securing material 72. In this way, the entire auxiliary panel 22 may be removed as desired. Additionally, the edges 68, 70 may be attached to the main panel in a variety of ways. Other means of attachment, including, but not limited to zippers 72", buttons 72", and snaps 72'" made be used as needed, as shown in FIGS. 2A, 2B, and 2C. Moreover, while the placement of the auxiliary panel against the lower surface 66, of the main panel 12 makes a sheet construction 10 particularly suited for use with young children, the auxiliary panel may also be attached to the upper surface 74 of the main panel, as well.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A sheet construction having a discrete integrated pillow shaped enclosure adapted to fittingly engage a mattress, said sheet construction comprising:

a main panel having a first end and a second end;

a first pouch disposed at said main panel first end, said first pouch adapted to encompass a first end of a mattress;

a second pouch disposed at said main panel second end, said second pouch adapted to encompass a second end of a mattress;

an auxiliary panel affixed to a mattress-facing surface of said main panel, said auxiliary panel having a plurality of edges forming a perimeter, all of said edges being attached to said mattress-facing surface of said main panel to form said pillow shaped enclosure; said pillow shaped enclosure being constructed and arranged so as to accommodate a pillow to be inserted therein, said pillow shaped enclosure being adapted to substantially surround said pillow and to secure said pillow against said mattress facing surface of said main panel;

whereby said first pouch and said second pouch cooperate to secure said main panel to a mattress and said pillow shaped enclosure is adapted to enclose the pillow and to secure said pillow against said main panel.

2. The sheet construction of claim 1, wherein said auxiliary panel edges include at least one insertion edge removably attached to said mattress facing surface of said main panel, said at least one insertion edge being sized to allow passage of said pillow between said auxiliary panel and said main panel when said edge is separated from said main panel.

3. The sheet construction of claim 2, wherein said at least one edge is attached to said main panel by hook-and-loop fastening material.

4. The sheet construction of claim 2, wherein said at least one edge is attached to said main panel by a zipper.

5. The sheet construction of claim 2, wherein said at least one edge is attached to said main panel by at least one snap fastener.

6. The sheet construction of claim 2, wherein said at least one edge is attached to said main panel by at least one button.

7. The sheet construction of claim 2, wherein said second pouch is characterized by a plurality of cooperating flaps extending from said main panel.

8. The sheet construction of claim 7, wherein each of said flaps includes a fastener, whereby adjacent flaps are releasably linked together.

9. A sheet construction having a discrete integrated pillow shaped enclosure adapted to secure a pillow and to fittingly engage a mattress, said sheet construction comprising:

a main panel having a first end and a second end;

a first pouch disposed at said main panel first end, said first pouch adapted to encompass a first side of a mattress;

a second pouch disposed at said main panel second end, said second pouch adapted to encompass a second side of a mattress;

an auxiliary panel affixed to a mattress-facing surface of said main panel, said auxiliary panel having a plurality of edges forming a perimeter, all of said edges being attached to said mattress-facing surface of said main panel to form said pillow shaped enclosure; said pillow shaped enclosure being constructed and arranged so as to accommodate a pillow to be inserted therein, said pillow shaped enclosure being adapted to substantially surround said pillow and to secure said pillow against said mattress facing surface of said main panel;

whereby said first pouch and said second pouch cooperate to secure said main panel to a mattress and said pillow shaped enclosure is adapted to enclose the pillow and to secure said pillow against said main panel.

10. The sheet construction of claim 9, wherein said auxiliary panel edges include at least one insertion edge removably attached to said mattress facing surface of said main panel, said at least one insertion edge being sized to allow passage of said pillow between said auxiliary panel and said main panel when said edge is separated from said main panel.

11. The sheet construction of claim 10, wherein said at least one edge is attached to said main panel by hook-and-loop fastening material.

12. The sheet construction of claim 10, wherein said at least one edge is attached to said main panel by a zipper.

13. The sheet construction of claim 10, wherein said at least one edge is attached to said main panel by at least one snap fastener.

14. The sheet construction of claim 10, wherein said at least one edge is attached to said main panel by at least one button.

15. The sheet construction of claim 10, wherein said second pouch is characterized by a plurality of cooperating flaps extending from said main panel.

16. The sheet construction of claim 15, wherein each of said flaps includes a fastener, whereby adjacent flaps are releasably linked together.

* * * * *